US005320572A

United States Patent [19]

Chen

[11] Patent Number: 5,320,572

[45] Date of Patent: Jun. 14, 1994

[54] TOY MOVABLE ON A CORD

[76] Inventor: Hwa-Lo Chen, 5F, No. 56, Chin-Chiang St., Taipei City, Taiwan

[21] Appl. No.: 150,419

[22] Filed: Nov. 10, 1993

[51] Int. Cl.[5] ..... A63H 11/04

[52] U.S. Cl. ..... 446/315; 446/229; 446/354; 254/270; 254/345

[58] Field of Search ..... 254/229, 270, 266, 342, 254/345, 362; 40/430; 446/227-229, 314, 315, 322, 323, 353, 354

[56] References Cited

U.S. PATENT DOCUMENTS

| | | | |
|---|---|---|---|
| 2,675,991 | 4/1954 | Waterstreet | 254/269 |
| 2,813,434 | 11/1957 | Stuebs | 254/269 X |
| 4,878,875 | 11/1989 | Pin-Hung et al. | 446/314 X |

*Primary Examiner*—Danton D. DeMille
*Attorney, Agent, or Firm*—Daniel H. Bliss

[57] ABSTRACT

A toy is hung and is movable on a cord between an upper limit position and a lower limit position. The toy includes a frame unit, a driving device, a planetary gearing, and a cord winding gearing assembly. The driving device has a power source installed on the frame unit, and a first output shaft journalled on the frame unit and driven by the power source. The sun gear of the planetary gearing is sleeved fixedly on the first output shaft so that, when driven by the driving device, the planetary gear of the planetary gearing rotates about the first output shaft. A return spring interconnects the frame unit and the cord winding gearing assembly so as to bias the driving gear of the cord winding gearing assembly to engage the planetary gear of the planetary gearing. The cord winding gearing assembly includes a reel connected to the cord winding gearing assembly so as to be driven by the power source to rotate in a direction, thereby winding the cord thereon. The driving gear and the planetary gear winds the cord on the reel so as to cause the toy to ascend along the cord to the upper limit position. The disengagement of the driving gear from the planetary gear causes the cord to unwind from the reel so as to enable the toy to descend along the cord to the lower limit position.

2 Claims, 6 Drawing Sheets

TOY MOVABLE ON A CORD

BACKGROUND OF THE INVENTION

1. Field of The Invention

This invention relates to a toy, more particularly to a toy which is hung on the lower end portion of a cord and which is capable of reciprocating movement on the cord.

2. Description of the Related Art

Owing to the scientific change with each passing day, various toys that are movable in different manners are required to satisfy the needs of the consumer.

SUMMARY OF THIS INVENTION

The main objective of this invention is to provide a toy which is hung on the lower end portion of a cord and is capable of reciprocating movement on the cord.

According to this invention, a toy is hung on a cord and is movable on the cord between an upper limit position and a lower limit position. The toy includes a frame unit, a driving device, a planetary gearing, and a cord winding gearing assembly. The driving device includes a power source which is installed on the frame unit, and a speed reduction gearing which has a first output shaft that is journalled on the frame unit and that is drivable by the power source. The planetary gearing is disposed on the frame unit and includes a sun gear sleeved fixedly on the first output shaft, a planet carrier with an end portion sleeved rotatably on the first output shaft, a planetary gear pivoted to the other end portion of the planet carrier and meshed with the sun gear, and a compression spring which biases the planetary gear to press against the planet carrier so as to rotate the planet carrier about the sun gear. The cord winding gearing assembly includes a movable plate, a driving gear, a driven gear, a positioning block, a return spring, and a reel. The movable plate has a first end portion and a second end portion. The driving gear is pivoted to the second end portion of the movable plate and meshes with the planetary gear. The driven gear is mounted rotatably on the second end portion of the movable plate and meshes with the driving gear. The positioning block is secured to the frame unit. The return spring interconnects the frame unit and the first end portion of the movable plate so as to bias the movable plate to abut against the positioning block, thereby engaging the driving gear with the planetary gear. The reel is connected securely and coaxially to the driven gear so as to rotate synchronously with the driven gear and is drivable indirectly by the power source to rotate in a direction so as to wind the cord on the reel and so as to move the toy upward along the cord to the upper limit position in which the reel cannot continue to rotate in the direction, thereby stopping the driving gear and the driven gear. Stopping of rotation of the driving gear and continued rotation of the planetary gear cause the driving gear to separate from the planetary gear when the toy is in the upper limit position. Separation of the driving gear from the planetary gear cause the cord to unwind from the reel so as to enable the toy to descend along the cord to the lower limit position due to weight of the toy.

Accordingly, when the power source is activated, the planetary gear rotates about the sun gear so as to effect alternate engagement and separation of the driving gear and the planetary gear, thereby causing reciprocating the toy to reciprocate along the cord.

BRIEF DESCRIPTION OF THE DRAWING

Other features and advantages of this invention will become apparent in the following detailed description of a preferred embodiment of this invention, with reference to the accompanying drawings, in which.

DETAILED DESCRIPTION OF THE PREFERRED EMBODIMENT

Figure 3:
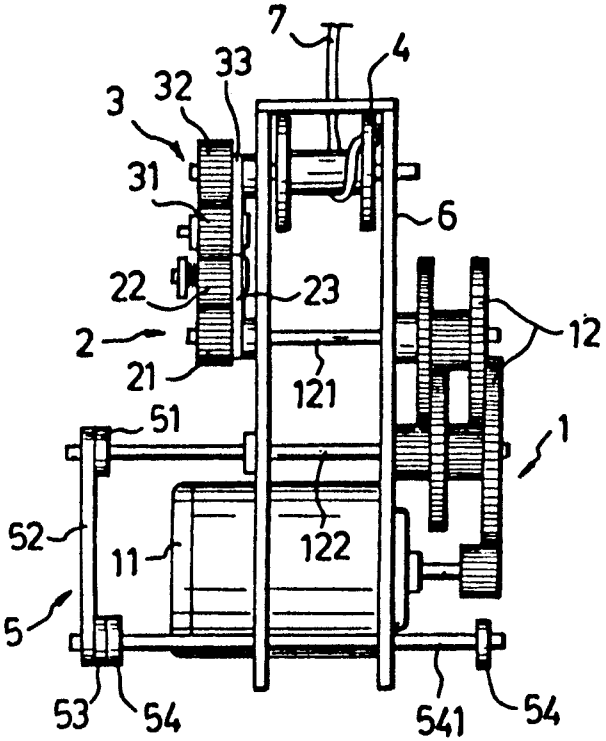
FIG. 3 is an elevational view showing the toy of this invention.

Referring to FIG. 3, a toy of the preferred embodiment of this invention includes a driving device 1, a planetary gearing 2, a cord winding gearing assembly 3, a sheave 4, a swing device 5, and a frame unit 6.

Figure 5:
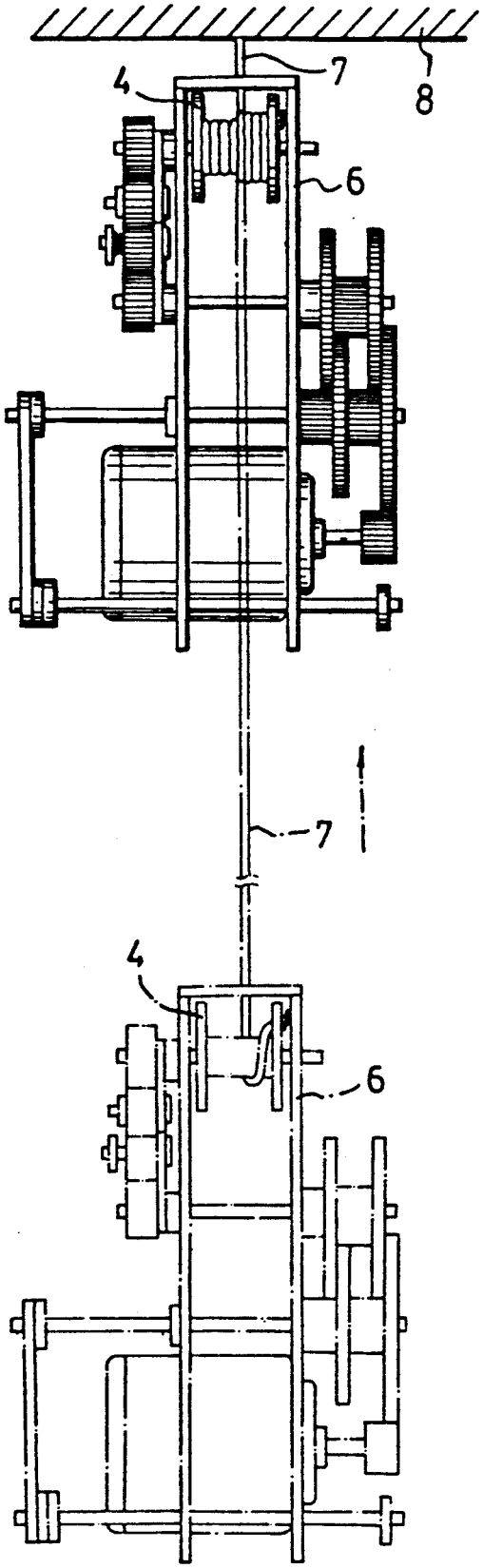
FIG. 5 is a schematic view illustrating how the toy is moved on the cord from a lower limit position to an upper limit position according to this invention.

The toy, as best illustrated in FIG. 5, is hung on the lower end portion of a cord 7 and is movable on the cord 7 between an upper limit position and a lower limit position. The cord 7 is secured to a ceiling 8 at the upper end portion thereof.

Figure 1:
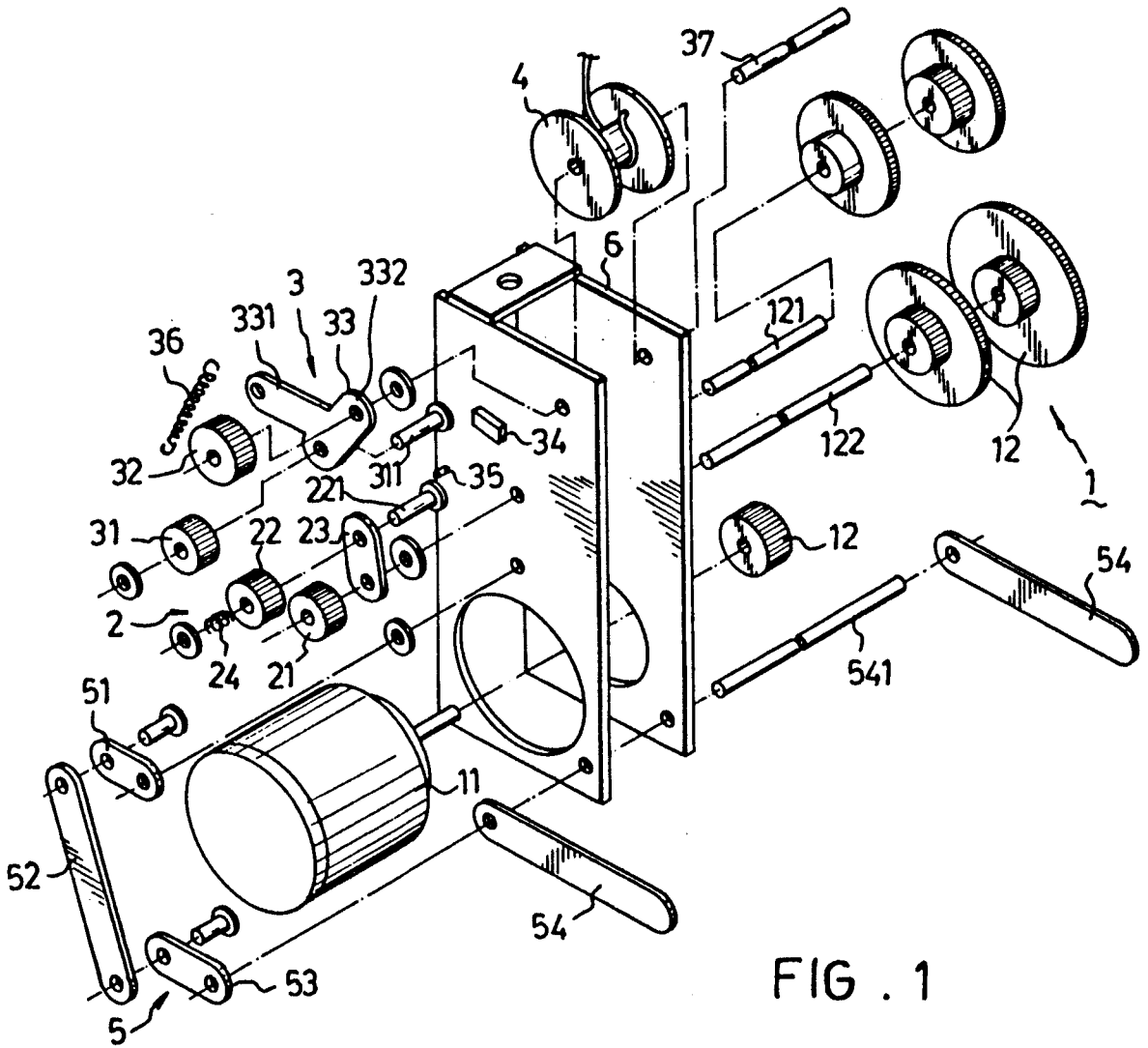
FIG. 1 is an exploded view of a toy of the preferred embodiment of this invention.
Figure 2:
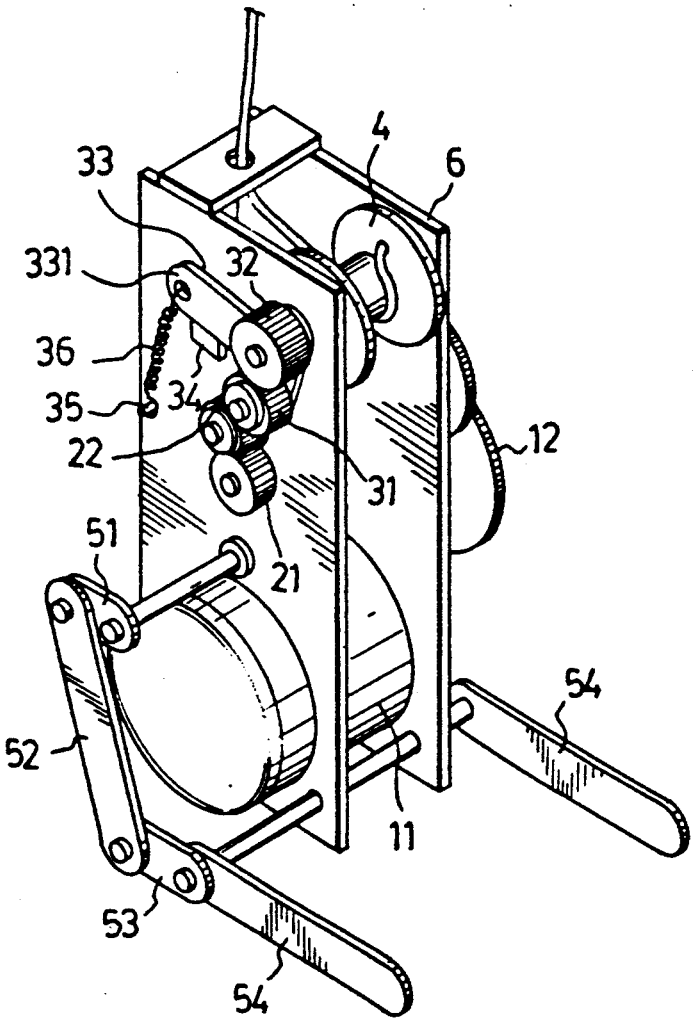
FIG. 2 is a perspective view showing the toy of this invention.

Referring to FIGS. 1 and 2, the driving device 1 includes a power source 11 which is installed in the accommodating holes of the lower portion of the frame unit 6, and a speed reduction gearing 12 which is connected to the power source 11 and which has a first output shaft 121 that is journalled on the frame unit 6. The power source 11 activates the speed reduction gearing 12 so as to drive the first output shaft 121.

The planetary gearing 2 is disposed on the frame unit 6 and includes a sun gear 21, a planetary gear 22, a planet carrier 23, and a compression spring 24. The sun gear 21 is sleeved fixedly on the first output shaft 121. The planet carrier 23 has an end portion which is sleeved rotatably on the first output shaft 121. The planetary gear 22 is pivoted to the other end portion of the planet carrier 23 by a pin 221 and meshes with the sun gear 21. The compression spring 24 is sleeved on the pin 221 so as to bias the planetary gear 22 to press against the planet carrier 23, thereby rotating the planet carrier 23 about the sun gear 21 when the sun gear 21 drives the planetary gear 22.

The cord winding gearing assembly 3 includes a driving gear 31, a driven gear 32, a movable plate 33, a positioning block 34, a protrusion 35, a return spring 36, and a reel 37. The movable plate 33 has a first end portion 331 and a second end portion 332. The driving gear 31 is pivoted to the second end portion 332 of the movable plate 33 by a pin 311 and meshes with the planetary gear 22 (see FIG. 2) when the planetary gear 22 is rotated about the sun gear 21 to an upper position. The driven gear 32 is mounted rotatably on the second end portion 332 of the movable plate 33 and meshes with the driving gear 31. The positioning block 34 is mounted securely on the side wall of the frame unit 6. The protrusion 35 projects outward from the side wall of the frame unit 6 below the positioning block 34. The return spring 36, as best shown in FIG. 2, interconnects the protrusion 35 and the first end portion 331 of the movable plate 33 so as to bias the movable plate 33 to abut against the positioning block 34, thereby engaging the driving gear 31 with the planetary gear 22. The reel 37 is connected securely and coaxially to the driven gear 32 so as to rotate synchronously with the driven gear 32.

Figure 4:
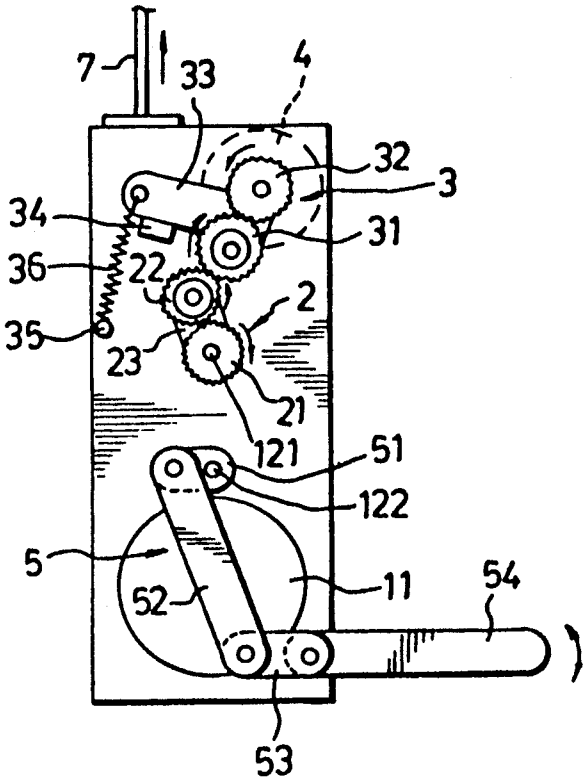
FIG. 4 is a schematic view illustrating how the toy is driven to move upward along a cord in accordance with this invention.
Figure 7:
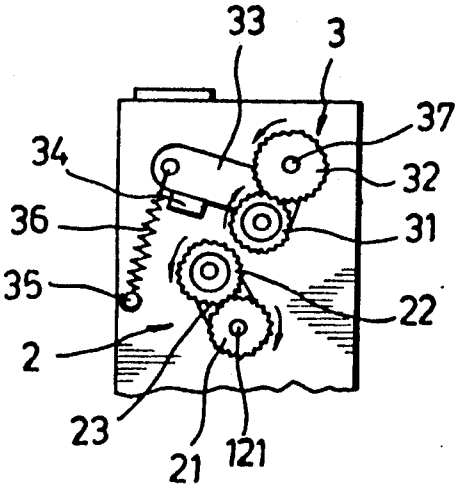
FIG. 7 is a schematic view illustrating the disengagement of the driving gear from the planetary gear of the toy.
Figure 6:
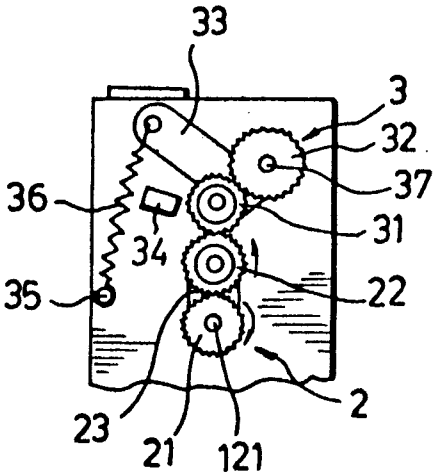
FIG. 6 is a schematic view illustrating the engagement of the planetary gear with the driving gear of the toy when the toy is at the upper limit position.
Figure 8:
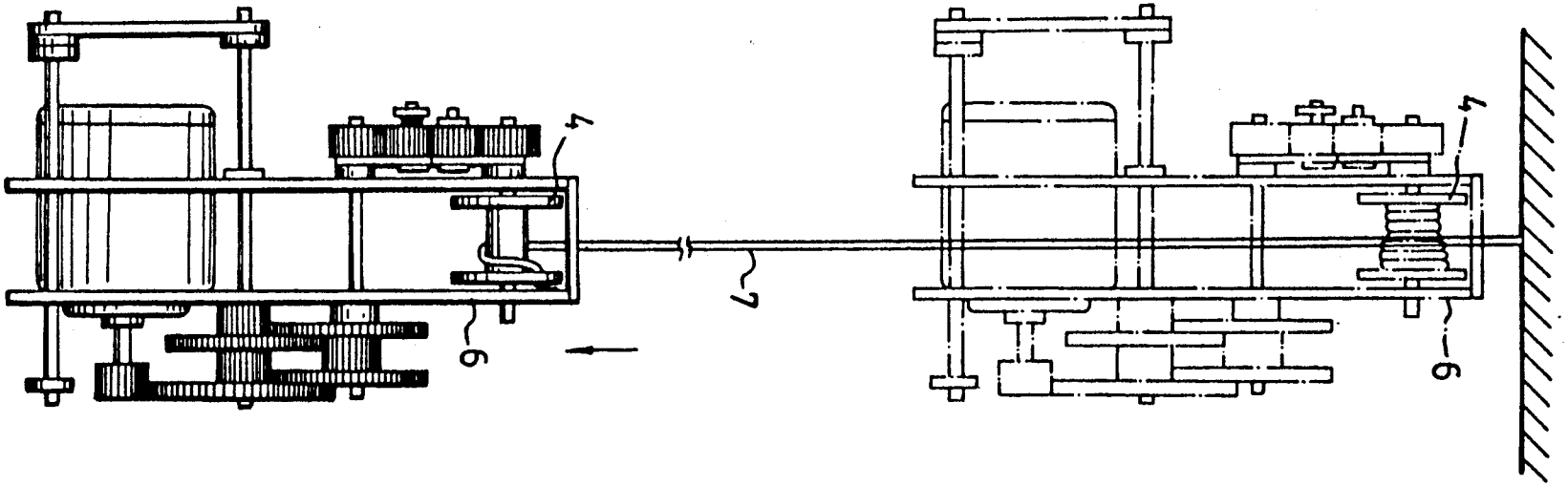
FIG. 8 is a schematic view illustrating how the toy is moved on the cord from the upper limit position to the lower limit position.

A sheave 4 is sleeved fixedly on the reel 37 between the side walls of the frame unit 6 so as to rotate synchronously with the reel 37. The lower end portion of the cord 7 is fastened to the sheave 4. Referring to FIG. 4, when the planetary gearing 2 and the cord winding gearing assembly 3 are actuated by the driving device 1, the reel 37 is drivable indirectly by the driven gear 32 in a direction so as to wind the cord 7 on the sheave 4 and move the toy upward along the cord 7 to the upper limit position, as shown in FIG. 5, in which the reel 37 cannot continue to rotate in the direction, thereby stopping the rotation of the driving gear 31 and the driven gear 32. Referring to FIGS. 6 and 7, when the toy is at the upper limit position, stopping of the rotation of the driving gear 31 and continued rotation of the planetary gear 22 cause the driving gear 31 to separate from the planetary gear 22 due to pushing action of the teeth of the planetary gear 22 toward the teeth of the driving gear. Separation of the driving gear 31 from the planetary gear 22 causes the cord 7 to unwind from the reel 37 so as to enable the toy to descend along the cord 7 to the lower limit position due to the weight of the toy, as shown in FIG. 8.

Accordingly, when the power source 11 is activated, the planetary gear 22 rotates about the sun gear 21 so as to effect alternate engagement and separation of the driving gear 31 and the planetary gear 22, thereby causing the toy to reciprocate on the cord 7.

Again referring to FIGS. 1 and 2, the toy further includes a swing device 5 which is coupled with the speed reduction gearing 12. The speed reduction gearing 12 further includes a second output shaft 122 which is journalled on the frame unit 6 and which is drivable by the power source 11. The swing device 6 includes a linkage and two swing arms 54. The linkage consists of a first crank 51, a second crank 53 and a coupler 52 which interconnects pivotally the end portions of the first and second cranks 51, 53. Each of the swing arms 54 has a connecting rod 541 which is journalled on the frame unit 6 and which interconnects pivotally the swing arms 54 so as to permit swinging of the swing arms 54 on the frame unit 6. The first and second cranks 51, 53 of the linkage are respectively pivoted to the second output shaft 122 of the speed reduction gearing 12 and the connecting rod 541 of the swing arms 54 in such a manner that the actuation of the power source 11 swings the swing arms 54.

With this invention thus explained, it is apparent that numerous modifications and variations can be made without departing from the scope and spirit of this invention. It is therefore intended that this invention be limited only as indicated in the appended claims.

I claim:

1. A toy movable on a cord, said toy being hung on said cord and being movable on said cord between an upper limit position and a lower limit position, said toy comprising:

a frame unit;

a driving device including a power source installed on said frame unit, and a speed reduction gearing having a first output shaft which is journalled on said frame unit and which is drivable by said power source;

a planetary gearing disposed on said frame unit and including a sun gear sleeved fixedly on said first output shaft, a planet carrier with an end portion sleeved rotatably on said first output shaft, a planetary gear pivoted to the other end portion of said planet carrier and meshed with said sun gear, and a compression spring which biases said planetary gear to press against said planet carrier so as to rotate said planet carrier about said sun gear; and a cord winding gearing assembly including a movable plate having a first end portion and a second end portion, a driving gear pivoted to said second end portion of said movable plate and capable of meshing with said planetary gear when said planetary gear is rotated about said sun gear to an upper position, a driven gear mounted rotatably on said second end portion of said movable plate and meshed with said driving gear, a positioning block secured to said frame unit, a return spring which interconnects said frame unit and said first end portion of said movable plate so as to bias said movable plate to abut against said positioning block in order to engage said driving gear with said planetary gear, and a reel connected securely and coaxially to said driven gear so as to rotate synchronously with said driven gear, said reel being drivable indirectly by said power source and by engagement of said driving gear and said planetary gear to rotate in a direction so as to wind said cord on said reel and so as to move said toy upward along said cord to said upper limit position in which said reel cannot continue to rotate in the direction, thereby stopping said driving gear and said driven gear, stopping of rotation of said driving gear and continued rotation of said planetary gear causing said driving gear to separate from said planetary gear when said toy is in the upper limit position, separation of said driving gear from said planetary gear causing said cord to unwind from said reel so as to enable said toy to descend along said cord to said lower limit position due to weight of said toy;

whereby, when said power source is activated, said planetary gear rotates about said sun gear so as to effect alternate engagement and separation of said driving gear and said planetary gear, thereby causing said toy to reciprocate on said cord.

2. A toy as claimed in claim 1, further comprising a swing device coupled with said speed reduction gearing, said speed reduction gearing further including a second output shaft which is journalled on said frame unit and which is drivable by said power source, said swing device including two swing arms mounted swingably on said frame unit, and a linkage interconnecting said speed reduction gearing and said swing arms in such a manner that actuation of said power source swings said swing arms.

* * * * *